US012557926B2

(12) United States Patent
Moua et al.

(10) Patent No.: US 12,557,926 B2
(45) Date of Patent: Feb. 24, 2026

(54) BLANKET SYSTEM WITH FLAPS

(71) Applicant: Flappy Blanky LLC, Sioux Falls, SD (US)

(72) Inventors: Djoua G. Moua, Woodland Hills, CA (US); James R. Edmunds, Sioux Falls, SD (US)

(73) Assignee: Flappy Blanky LLC, Sioux Falls, SD (US)

( * ) Notice: Subject to any disclaimer, the term of this patent is extended or adjusted under 35 U.S.C. 154(b) by 19 days.

(21) Appl. No.: 18/745,369

(22) Filed: Jun. 17, 2024

(65) Prior Publication Data

US 2025/0228380 A1 Jul. 17, 2025

Related U.S. Application Data

(60) Provisional application No. 63/620,942, filed on Jan. 15, 2024.

(51) Int. Cl.
*A47G 9/02* (2006.01)

(52) U.S. Cl.
CPC ..... *A47G 9/0223* (2013.01); *A47G 9/023* (2013.01)

(58) Field of Classification Search
CPC ..... A47G 9/023
See application file for complete search history.

(56) References Cited

U.S. PATENT DOCUMENTS

| | | | | |
|---|---|---|---|---|
| 2,736,043 | A * | 2/1956 | Temple | A47G 9/0238 5/502 |
| 5,023,969 | A * | 6/1991 | Nattrass | A47G 9/023 5/486 |
| 5,664,269 | A | 9/1997 | Broder | |
| 7,100,223 | B1 * | 9/2006 | Anthony | A47G 9/0238 5/482 |
| 8,214,947 | B1 * | 7/2012 | Helton | A47G 9/023 5/482 |
| D791,511 | S | 7/2017 | Walker | |
| D1,058,241 | S | 1/2025 | Cowger | |
| 2007/0169264 | A1 | 7/2007 | Spicer | |
| 2020/0128978 | A1 * | 4/2020 | Werthaiser | A47G 9/023 |
| 2021/0219751 | A1 | 7/2021 | Lewis | |

FOREIGN PATENT DOCUMENTS

| | | | | |
|---|---|---|---|---|
| GB | 2341089 | A1 | 8/2000 | |
| WO | WO-2005053471 | A1 * | 6/2005 | A47G 9/0261 |

OTHER PUBLICATIONS

International Search Report and the Written Opinion of the International Searching Authority for International Application No. PCT/US2024/048714, dated Jan. 24, 2025.

* cited by examiner

*Primary Examiner* — Sarah B Mcpartlin
(74) *Attorney, Agent, or Firm* — TechLaw Ventures, PLLC; Bretton L. Crockett

(57) ABSTRACT

The present disclosure is directed to multi-layer blanket systems which accommodate the insulation needs of one sleeper or two sleepers, by incorporating flaps that are disposed to open or close ports that can be disposed over different body parts of each sleeper, while keeping the sleeper covered by a lower layer of the system. In some illustrative embodiments, the flaps can be folded off the bed to decrease the amount of insulation on that particular body part for that particular sleeper or left on the bed to increase the amount of insulation on that particular body part for that particular sleeper.

20 Claims, 5 Drawing Sheets

BLANKET SYSTEM WITH FLAPS

CROSS-REFERENCE TO RELATED APPLICATION

This application claims priority to U.S. Provisional Patent Application No. 63/620,942, filed Jan. 15, 2024, which is incorporated herein by reference in its entirety, including but not limited to those portions that specifically appear hereinafter.

BACKGROUND

When sleeping in a bed, we regulate body temperature through the insulating effect of bedding such as sheets and blankets. Bedding which provides appropriate insulation enhances sleep quality and quality of life. Achieving the optimal level of insulation poses a challenge. Each individual's need for insulation is different and changing depending on many factors. For example: different individuals have different overall needs for insulation. These can be affected by factors such as: ambient temperature and yearly seasonality, the varied phases of the sleep cycle, the body heat and sleeping positions of partners and/or pets, medical conditions (such as pregnancy, obesity, peripheral vascular disease, menopause, diabetes-induced peripheral artery disease, etc.), and other factors.

Further complicating the issue, different body parts of individuals have different and changing insulation needs. Some individuals have hot or cold feet, some have hot or cold midsections, some have hot or cold shoulders and upper bodies, and so on. The needs of each specific body part of each individual may change depending on different factors as well.

When two sleepers share the same bed, the difficulty in finding optimal levels of insulation for each body part of each sleeper increases. Co-sleepers often prefer to share the same blanket, promoting intimacy and basic human needs for contact, so a single solution is preferable.

Traditional top beddings consist of a flat sheet and a blanket providing insulation. Traditional blankets provide limited flexibility to regulate body temperature, particularly different body parts and particularly when a bed is shared. For example, an individual with a hot midsection but cold feet cannot easily position a single blanket to accommodate the need for coolness in the midsection and warmth in the feet. Additionally, moving the blanket pulls other sections and might adversely affect the partner's insulation needs. Completely removing a blanket from a body part is not a comfortable solution since many individuals sleep better when under some covering. Removing a blanket from a body part might also disturb a partner.

Split blankets, a common and traditional solution for two sleepers, consist of two blanket sections, one for each sleeper. Each side can be removed or adjusted in various ways, and thus operated as a separate blanket, giving some flexibility by individual. None allow for regulation by body part for each individual while still allowing partners to easily touch one another. For example, US 2009/0249547, the contents of which are incorporated herein by reference in their entirety, provides a simple split blanket mechanism with zipper, does not allow for (a) regulation of a blanket's level of insulation (b) by body part, (c) quickly and easily (d) while not disturbing the overall position of the blanket for the sleeper (e) while allowing for contact between sleepers like a traditional blanket.

U.S. Pat. No. 6,237,171, the contents of which are incorporated herein by reference in their entirety, provides a construct with pockets that allow for the insertion of insulation. These do not allow for (a) regulation of a blanket's level of insulation (c) by body part, (d) quickly and easily (e) while not disturbing the overall position of the blanket for the sleeper.

US 2023/0270268, the contents of which are incorporated herein by reference in their entirety, discloses a modular blanket, where multiple smaller blankets can be linked edge to edge together to create custom sized blankets, do not allow for (a) regulation of a blanket's level of insulation, (b) quickly and easily (c) while not disturbing the overall position of the blanket for the sleeper or other sleepers or pets, and (d) is comfortable, simple and natural.

Thus, known solutions are typically overly complex, or disruptive to those sharing a bed.

Therefore, a need exists for a new and improved solution that allows for regulation of a blanket's level of insulation by sleeper and by body part, which would be an improvement in the art. Such a solution that can be quickly and easily adjusted by one sleeper while not disturbing the overall position of the blanket for the sleeper or other sleepers or pets, while allowing for contact between sleepers like a traditional blanket would be a further improvement in the art.

SUMMARY

The present disclosure is directed to multi-layer blanket systems which accommodate the insulation needs of one sleeper or two sleepers, by incorporating flaps that open or close ports that can be disposed over different body parts of each sleeper, while keeping the sleeper covered by a lower layer of the system. In some illustrative embodiments, the flaps can be folded off the bed to decrease the amount of insulation on that particular body part for that particular sleeper or left on the bed to increase the amount of insulation on that particular body part for that particular sleeper.

In some illustrative embodiments, a blanket system in accordance with present disclosure may include two levels or layers. The upper layer or level may be a thicker upper or top layer (similar to a traditional blanket, quilt, fleece, or comforter) laid over and attached to a lower layer or level which is a bottom thinner fabric (similar to standard bedsheet or lining). The upper layer may include fixed portions that define a number of ports and a number of flaps that correspond to the ports. The flaps allow each sleeper to increase or decrease the amount of insulation to different parts of their bodies without the need to displace the entire blanket. A sleeper can remove the thicker top layer away from a particular section of the sleeper's body by folding the respective flap laterally, from the center towards or off the side of the bed. When a flap is open, the thicker upper layer of that section may hang off the bed rather than on top of the sleeper, and the blanket will provide only the thinner lower level of insulation over the respective body portion, allowing that body part to be relatively cooler. When a flap is closed, that section of the blanket will provide both the upper and lower layers of insulation to that respective portion of the body.

Parallel ports may be disposed on either side of a midline of the system, to allow co-sleepers to individually select and adjust specific respective ports. For example, when a first sleeper is too hot in their midsection, the flap over their midsection can be folded to the lateral side of the bed, cooling that area while allowing for remaining sections of the blanket system (and the parts covering the other sleeper) to continue providing full warmth. Likewise, if the second sleeper has warm feet, the second sleeper can fold off the flap covering their feet and lower legs without disrupting the remainder of the blanket. Both operations can be done without disturbing the other parts of the blanket covering either sleeper. Conversely, if a body part is too cool, a flap can be easily flipped back to its original position over the sleeper, without disturbing any other part of the blanket system.

Certain embodiments of blanket systems in accordance with the present disclosure may provide a solution to caretakers or medical professionals who need to access different body parts with minimal disruption of the blanket's position. Such embodiments may be similar to the dual layer embodiments discussed previously herein, with a layer including flaps and ports, with the ports having a bottom opening that is not permanently closed by the lower level. Thus, when a flap is opened, immediate access to the body part may be available to a caretaker or medical professional without disturbing the sleeper or other parts of the blanket system.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

It will be appreciated by those of ordinary skill in the art that the various drawings are for illustrative purposes only. The nature of the present disclosure, as well as other embodiments of in accordance with the present disclosure, may be more clearly understood by reference to the following detailed description, to the appended claims, and to the several drawings.

DETAILED DESCRIPTION

The present disclosure relates to apparatus, systems and methods for blankets and bedding. It will be appreciated by those skilled in the art that the embodiments herein described, while illustrating certain embodiments, are not intended to so limit this disclosure or the scope of the appended claims. Those skilled in the art will also understand that various combinations or modifications of the embodiments presented herein can be made without departing from the scope of this disclosure. All such alternate embodiments are within the scope of the present disclosure.

Figure 1A:
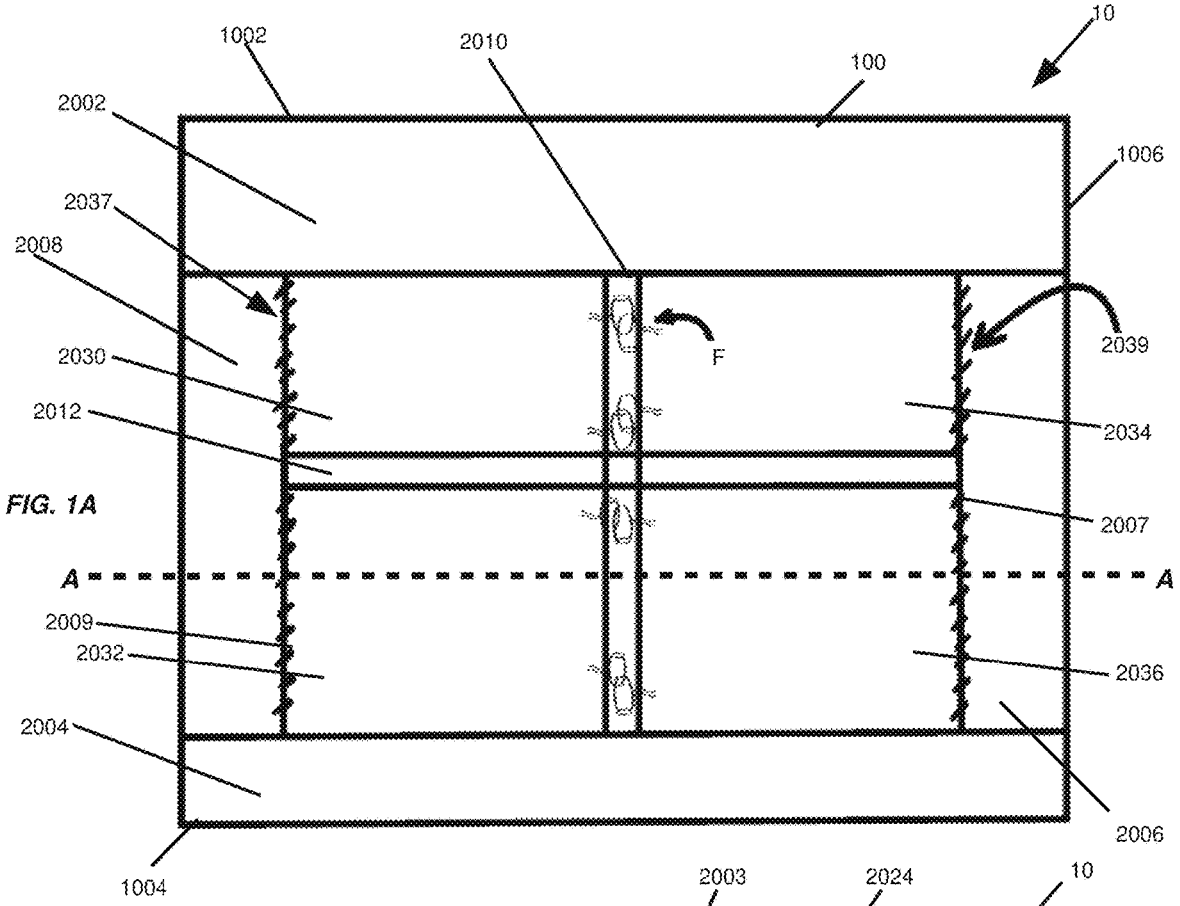
FIG. 1A depicts a top view of a first blanket system in accordance with the present disclosure, laid flat with the flaps in a closed position.
Figure 1B:
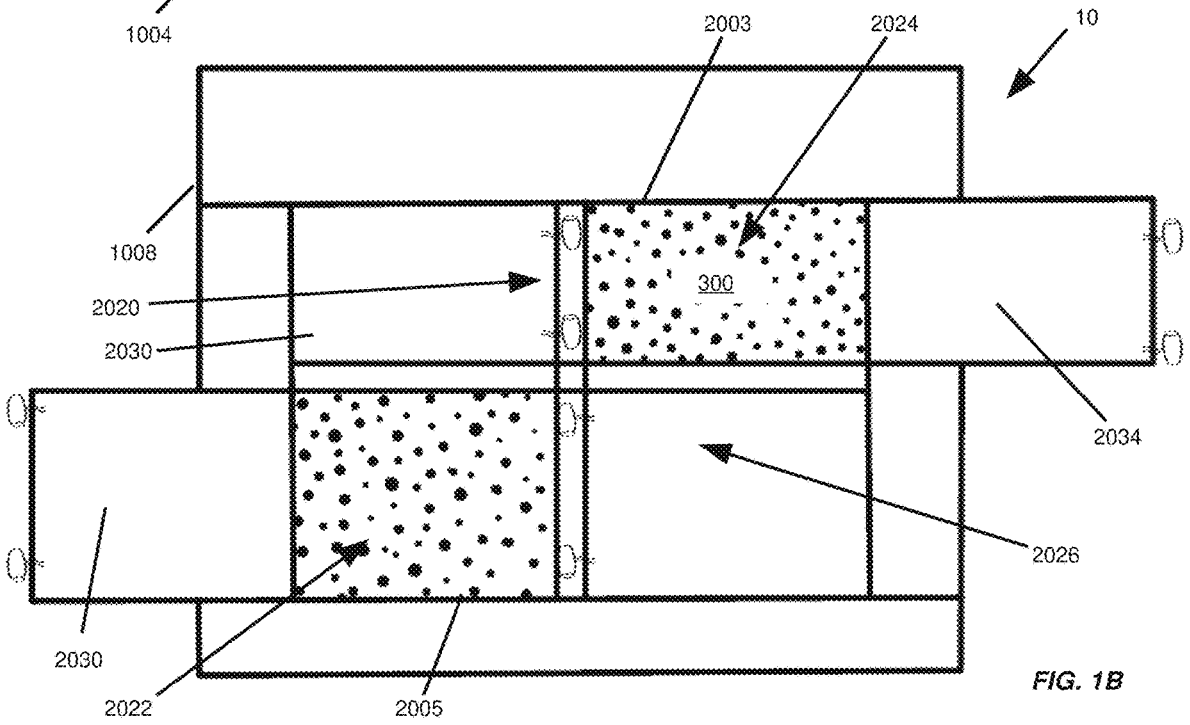
FIG. 1B depicts the system of FIG. 1A, with two of the flaps in an open position.
Figure 1C:
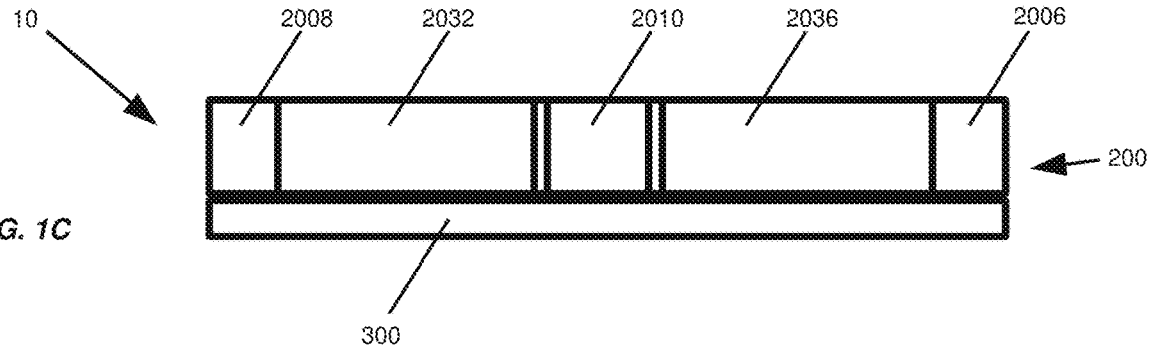
FIG. 1C is a cross-sectional view of the system of FIGS. 1A-1B, taken along line A-A of FIG. 1A.

Referring to FIGS. 1A, 1B, 1C, 1D, 1E, 1F and 2, a first embodiment of a multilayer blanket system 10 is depicted. As depicted, the system 10 may be formed as a body 100, which when laid flat has a generally rectangular shape which with upper and lower surfaces, easily imagined in simplest form as one normal blanket (upper surface) laid over a sheet (lower surface) as shown in FIG. 1C. Body 100 extends from a top edge 1002 at a "head" of the blanket to a lower edge 1004 at a "foot" of the blanker and from a first side edge 1006 to an opposite second side edge 1008.

Figure 1D:
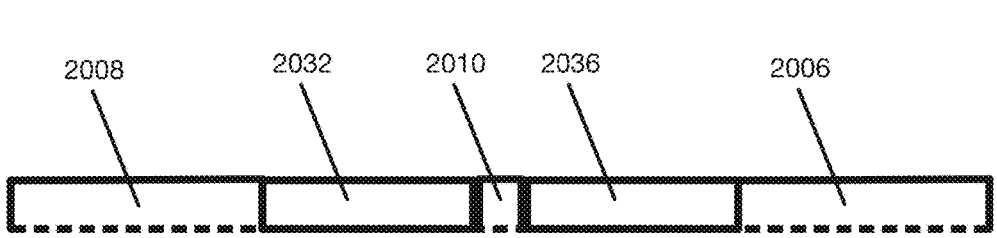
FIGS. 1D, 1E and 1F are alternate cross-sectional views of the system of FIGS. 1A-1B illustrating the close relationship between layers of the system during use.
Figure 1E:
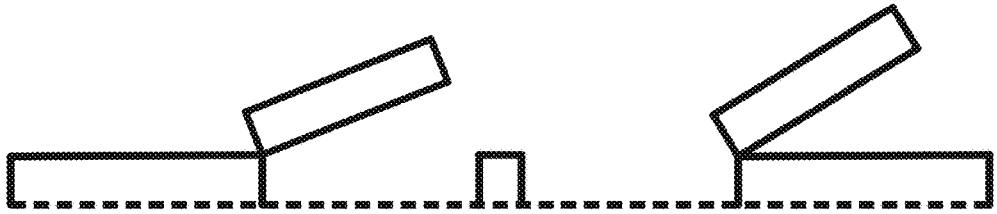
Figure 1F:
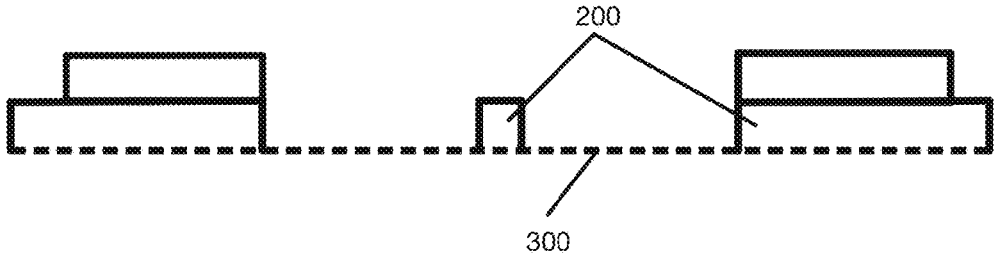

Body 100 may be formed from different layers that are joined to one another. A lower or base layer 300 may extend across the entire lower surface of the body 100. In some embodiments, the base layer 300 may be formed from a relatively thinner fabric, similar to a standard bedsheet or a lining material. FIG. 1D, FIG. 1E, and FIG. 1F depict another view of this cross section, with flaps in closed, opening, and open positions, respectively. The upper level 200 and lower level 300 (dotted line) reside in close proximity to on another when the flaps are in the closed position. To a user under the system 10, they will effectively as a single unit in all areas except the opened ports. Where the ports are open, only the lower level exists, providing a smooth uninterrupted bottom surface in contact with the user.

An upper layer 200 may be formed as a relatively "warmer" layer in comparison to the bottom layer 300, in that it has a higher relative insulative value. For example, it could be formed from a woven or piled textile used in typical blanket. In some embodiments, the upper layer could be formed similar to a duvet, quilt or comforter, including an insulative material like down or other insulating fill, sandwiched between a shell consisting of an upper and lower covering textile material.

The upper layer may include a frame portion that includes an upper or head frame member 2002 formed as a portion extending across the width of the blanket from the top edge 1002 towards the center of the body to a lower end 2003 thereof. A lower or foot frame member 2004 may be formed as a portion extending across the width of the blanket from the bottom edge 1004 towards the center of the body to an upper end 2005 thereof. The frame portion may further include side members 2006 and 2008 that extend from the upper frame member 2002 and lower from member 2004 and inward from the respective side edge 1006 and 1008 towards the center of the body to inner ends 2007 and 2009, respectively. Inner frame members, such as vertical centerline member 2010 and horizontal member 2012 may be formed as columns or ribs extending between the inner sides of the frame members. The frame members of the upper layer 200 thus define a set of ports or windows in the upper layer 200. In the embodiment depicted in FIGS. 1A though 2, there are four ports 2020, 2022, 2024 and 2026. It will be appreciated that the various frame members may be constructed as a single unified unit, or as separate units that are attached together.

The upper layer 200 may be attached to the lower level 300 in all places except for the flaps. So, frame members 2002, 2004, 2006, 2008, 2010 and 2012 of the upper layer 200 may be sewn or otherwise attached to lower level 300 but flaps are not attached to the lower level, allowing them to be folded off, exposing only the lower level in the port.

Figure 2:
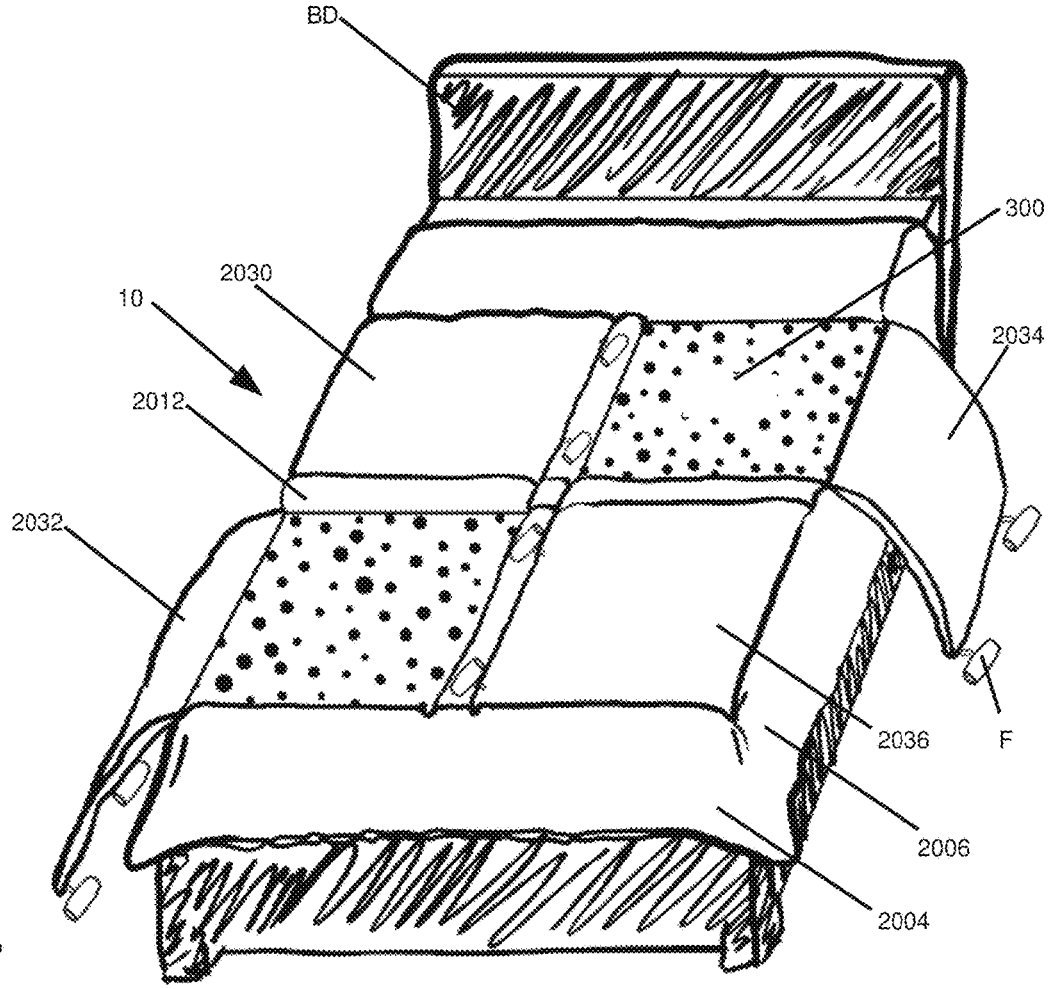
FIG. 2 depicts a perspective view of the system of FIGS. 1A to 1C, placed in position on a bed, with two of the flaps in an open position.

Upper layer 200 further includes a set of flaps that correspond to the ports. In the depicted embodiments, there are four flaps 2030, 2032, 2034 and 2036, each corresponding to a respective port 2020, 2022, 2024 and 2026. As depicted, each flap may be sized to correspond to its respective port. An outer or lateral edge of each port may be attached to a respective side frame member 2006 or 2008. In the depicted embodiment, each flap may be formed as a separate member that is secured in place to the side member as by stitching, as indicated by seams 2037 and 2039 (FIG. 1A). The inner edges, upper edges and lower edges of the flaps are free, allowing the flaps to be placed in the respective port to thereby close it, or to be lifted from the port and rotated laterally away therefrom, exposing the lower layer 300 at the bottom of the port. As depicted in FIG. 2, this may allow the flap to hang over the side of the bed away from the sleeper.

The ability to have each individual flap either placed in its respective port, or folded laterally away from the center towards or off the right or left side of the bed allows an individual sleeper to decrease or increase the insulation in a desired manner over a selected portion of their body. For example, consider the lower right flap 2032 which would cover the right-side sleeper's legs and feet. It is connected to the rest of the blanket system on the right-hand side with stitching 2039 and can be folded laterally to the right to hang off the side of the bed BD as depicted in FIG. 2. Such that lower layer 300 is exposed in the bottom of the port. When flap 2032 is closed, it can be fastened in position in port 2022 using appropriate fasteners, such as the depicted bead or button fasteners F. It will be appreciated that any suitable fastener may be used, including magnets, hook and loop fasteners or other suitable fasteners. It will further be appreciated that in certain embodiments, the fasteners may not be required as the size and/or weight of the flap may be sufficient to secure it in the port.

It will be appreciated that systems in accordance with the present disclosure can be constructed in different sizes that correspond to differing bedding sizes to allow the flaps to hang over the side of the bed in the open position. For example, systems can be constructed in full, double, queen, king and other bed sizes. A system constructed for a twin or single bed size may only include a single set or flaps allowing them to hang over a single side of the bed for an individual sleeper.

Figure 3A:
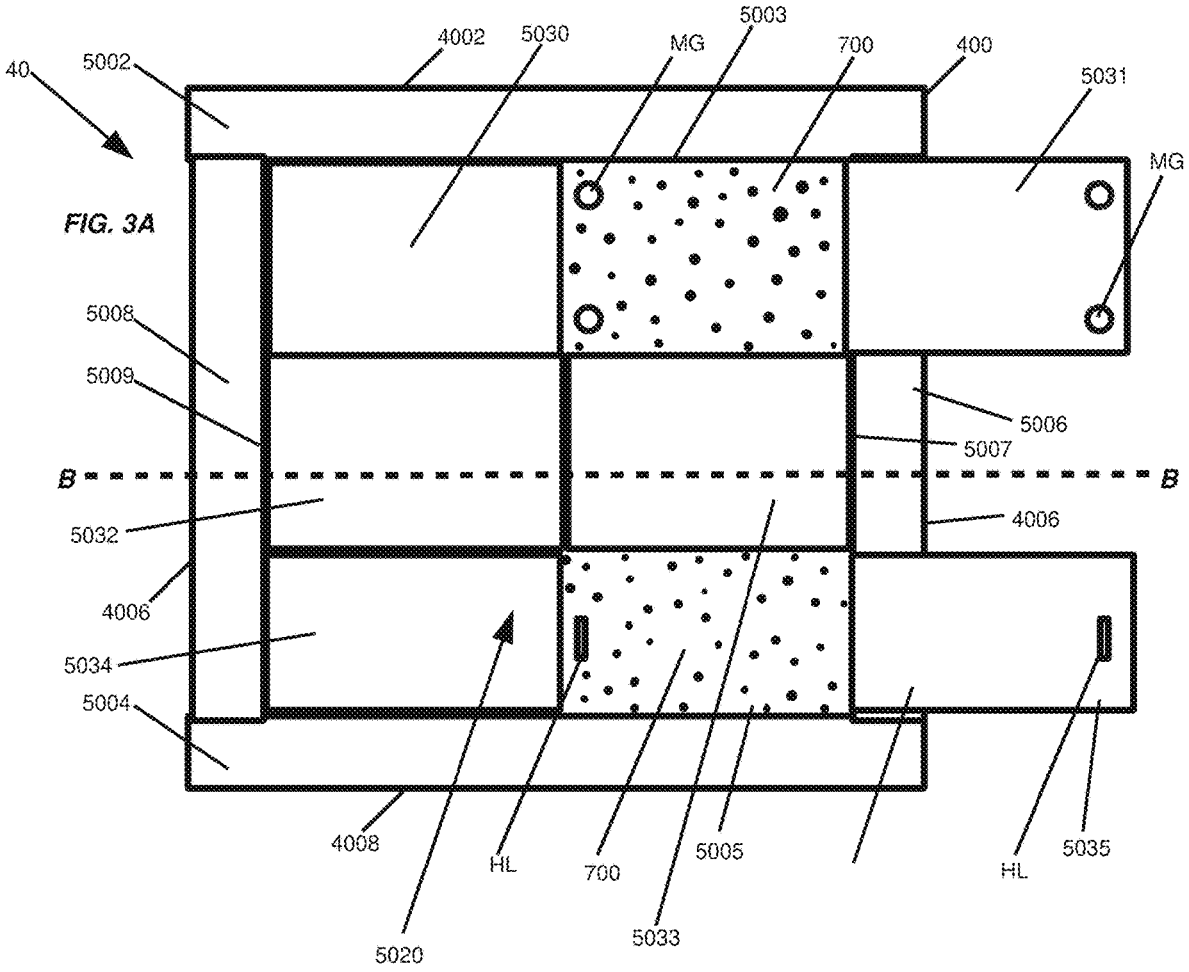
FIG. 3A is a top view of a second blanket system in accordance with the present disclosure, laid flat with two of the flaps in an open position and the remaining flaps in closed position.
Figure 3B:
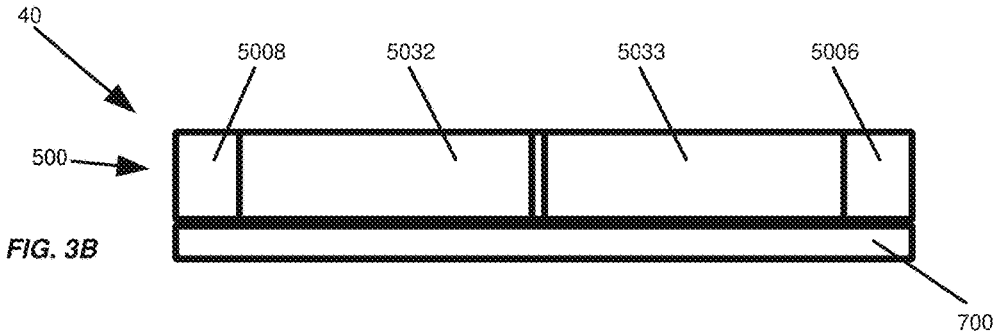
FIG. 3B is a cross-sectional view of the system of FIG. 3A, taken along line B-B of FIG. 3A.

Turning to FIGS. 3A, and 3B, another embodiment of a multilayer blanket system 40 in accordance with the teachings of the present disclosure is depicted. As depicted, the system 40 may be formed as a body 400, which when laid flat has a generally rectangular shape which with upper and lower surfaces that extends from a top end 4002 at a "head" of the blanket to a lower edge 4004 at a "foot" of the blanket and from a first side edge 4006 to an opposite second side edge 4008.

Body 400 may be formed from different layers that are joined to one another. A lower or base layer 700 may extend across the entire lower surface of the body 400. In some embodiments, the base layer 700 may be formed from a relatively thinner fabric, similar to a standard bedsheet or a lining material.

An upper layer 500 may be formed as a relatively "warmer" layer in comparison to the bottom layer 700, in that it has a higher relative insulative value. For example, it could be formed from a woven or piled textile used in typical blanket. In some embodiments, the upper layer 500 could be formed similar to a duvet or quilt, including an insulative material sandwich between an upper and lower covering textile material.

The upper layer may include a frame portion that includes an upper or head frame member 5002 formed as a portion extending across the width of the blanket from the top edge 4002 towards the center of the body to a lower end 5003 thereof. A lower or foot frame member 5004 may be formed as a portion extending across the width of the blanket from the bottom edge 4004 towards the center of the body to an upper end 5005 thereof. The frame portion may further include side members 5006 and 5008 that extend from the upper frame member 5002 and lower from member 5004 and inward from the respective side edges 5006 and 5008 towards the center of the body to inner ends 5007 and 5009, respectively. Unlike system 10 discussed previously herein, system 40 lacks body inner frame members and defines a single large port 5020.

Upper layer 500 further includes a set of flaps that correspond to different portions of the port 5020. In the depicted embodiments, there are six flaps, three on the right side, 5030, 5032, and 5034, and three on the left side, 5031, 5033 and 5035. As depicted, each flap may be sized such that they jointly correspond to cover the entire port 5020. An outer or lateral edge of each flap may be attached to the respective side frame member 5006 or 5008. In the depicted embodiment, each flap may be formed as a separate member that is secured in place to the side member as by stitching. The inner edges, upper edges and lower edges of the flaps are free, allowing the flaps to be placed in the port to thereby jointly close it, or to be lifted from the port and rotated laterally away therefrom, exposing the medial layer 600 at the bottom of the port in that portion. This may allow the flap to hang over the side of the bed away from the sleeper.

The ability to have each individual flap either placed in the port, or folded laterally away from the center towards or off the right or left side of the bed allows an individual sleeper to decrease or increase the insulation in a desired manner over a corresponding portion of their body. For example, consider the upper left flap 5031 which would cover the left side sleeper's upper body. It is connected to the rest of the blanket system on the left-hand side and can be folded laterally to the left to hang off the side of the bed BD thereby allowing the lower layer 700 to be exposed in the bottom of the port in that location. When flap 5031 is closed, it can be fastened in position in port 5020 using appropriate fasteners. In the depicted embodiment, the flap may be secured by the interaction of magnets MG in the flap and the lower layer. It will be appreciated that any suitable fastener may be used, including magnets, hook and loop fasteners or other suitable fasteners.

Similarly, lower left flap 5035 in upper layer 500 would cover the left side sleeper's feet. Lower left flap 5035 is connected to the rest of the blanket system on the left-hand side and can be folded laterally to the left to hang off the side of the bed BD thereby allowing the sleeper to either be covered by both layers or by just lower layer 700 in that location. When flap 5035 is closed, it can be fastened in position in using appropriate fasteners. In the depicted embodiment, the flap may be secured by the interaction of hook and look strips HL on the flap and the lower layer. It will be appreciated that any suitable fastener may be used, including magnets, hook and loop fasteners or other suitable fasteners.

As depicted, the opposite side flaps may contact one another along a centerline or midline of the body. Similarly, the flaps on each side may contact the upper and lower flaps on that side. This allows the port to be closed without the need for inner and outer frame members.

It will be appreciated that the use of a medial layer, allows for a 40 system with a fixed insulative layer and an adjustable insulative layer as depicted adjacent flap 5031. It may also allow for an additional layer of flaps in the medial layer 600. For example, under lower left flap 5035 in upper layer 500, a lower flap 6035 may be disposed in the medial layer 600, both of which would cover the left side sleeper's feet. Both flaps are connected to the rest of the blanket system on the left-hand side and can be folded laterally to the left to hang off the side of the bed BD thereby allowing the sleeper to either be covered by all three layers, by medial layer 600 and lower layer 700, or just by lower layer 700 in that location. When flap 6035 is closed, it can be fastened in position in using appropriate fasteners. In the depicted embodiment, the flap may be secured by the interaction of hook and look strips HL on the flap and the lower layer. It will be appreciated that any suitable fastener may be used, including magnets, hook and loop fasteners or other suitable fasteners.

Figure 4A:
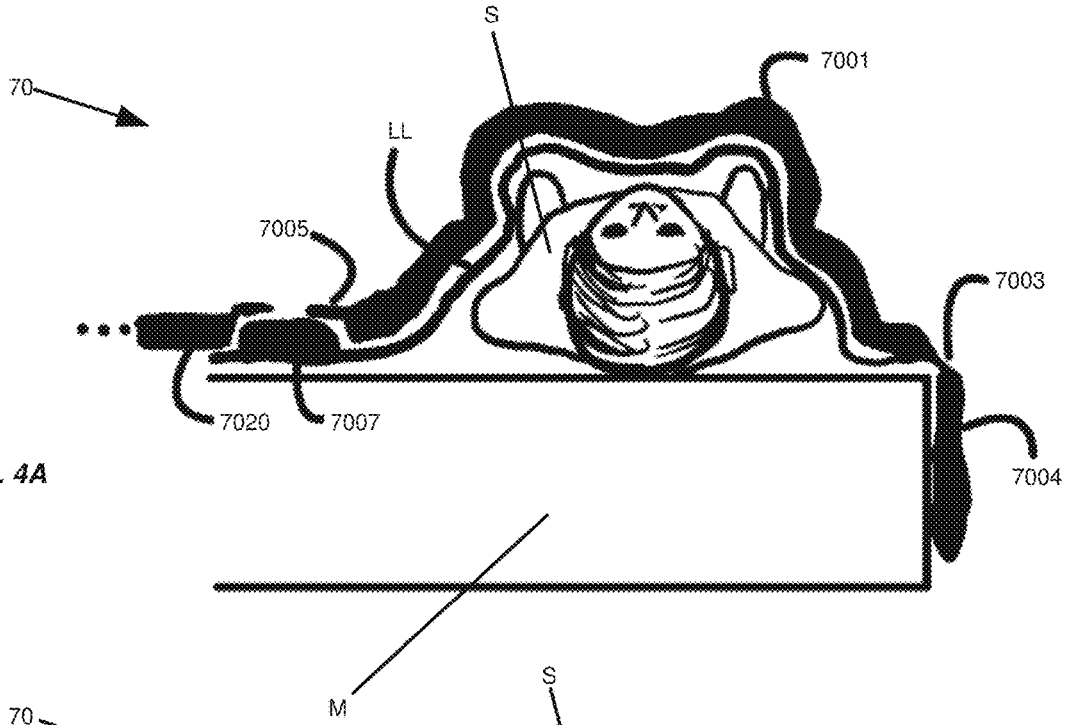
FIG. 4A is a side sectional view of a portion of one side of a blanket system in accordance with the present disclosure, positioned above a sleeper and mattress, with a flap in a closed position.
Figure 4B:
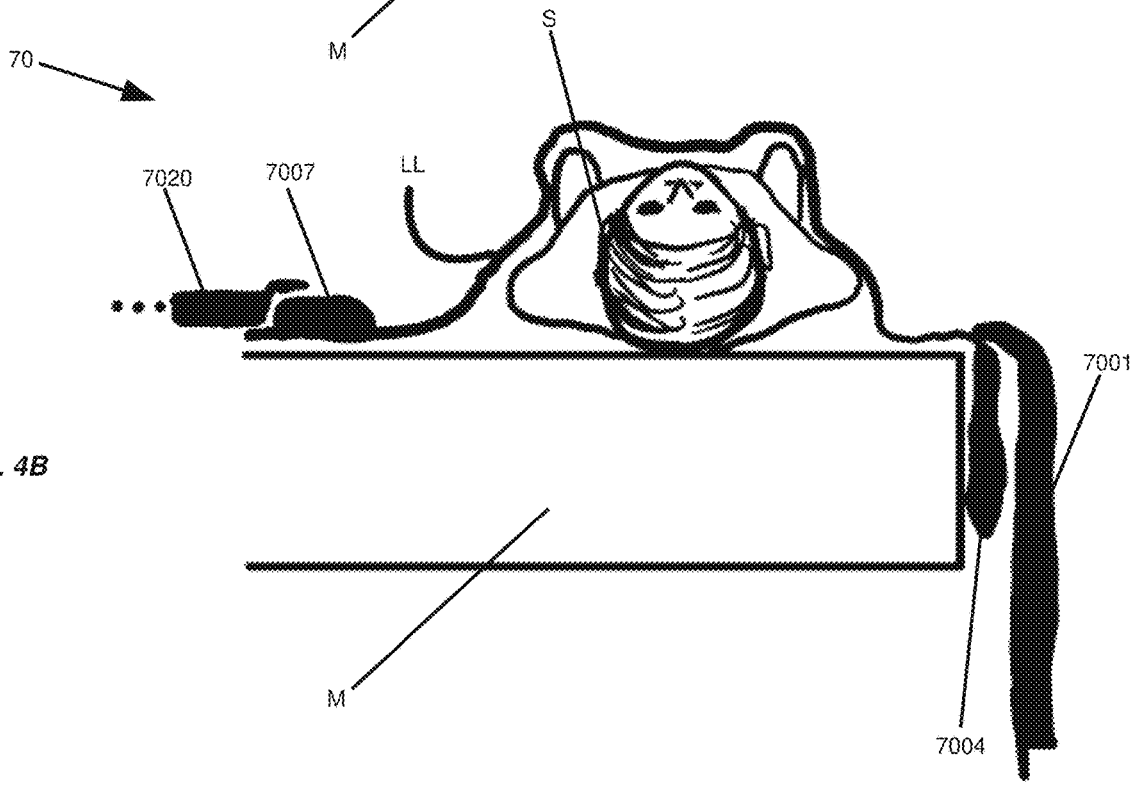
FIG. 4B is a side sectional view of a portion of one side of the blanket system of FIG. 4A, positioned above a sleeper and mattress, with a flap in an open position.

FIGS. 4A and 4B shows a side sectional view of one side of a blanket system 70, positioned above a sleeper S and mattress M, with a flap 7001 in a closed position (FIG. 4A) and an open position (FIG. 4B). As depicted, the flap 7001 is part of the upper or the top layer of the blanket system. Lower level LL remains in place and does not move with the flap 7001. Both levels are components of the entire system, and both lie on top of the sleeper S, and the mattress M during use. The system 70 is sized such that a side portion 7004 of the blanket system hangs off the side of the bed during use. The flap 7001 has free medial, top and bottom sides and is attached to the remainder of the top layer as indicated at 7003. This can be done by stitching or other attachment or forming the flap and side frame member as a continuous piece.

In this depicted embodiment, when the flap is closed, the medial end 7005 of the flap 7001 covers the medial vertical rib or frame member 7007 (as does the counterpart flap 7020). The flap 7001 may be secured to the rib 7007 by counterpart magnets, or hook and loop closures, attached to the flap and the rib. To position the flap 7001 in the closed position, the sleeper S places the flap 7001 in place and closes the fastener. To open, the sleeper detaches the fastener and folds the flap laterally off the bed as shown in FIG. 4A. When the flap 7001 is open, the thinner lower-level LL remains in place. Other embodiments might not include the medial end overlapping the rib.

Examples of fastener systems which might be employed include a toggle/loop or magnets, buttons, snaps, Velcro, Chinese knot, string tie, or similar mechanisms. Part of the fastener may be attached to the center part of the flap and the counterpart attached to the rib or directly to the lower-level LL via fabric tape, timing, casing or similar garment/bedding industry method. In some embodiments, no fasteners might be employed, relying on gravity to keep the flap in place.

The present disclosure is directed to multi-layer blanket systems which accommodate the insulation needs of one sleeper or two sleepers, by incorporating flaps that are disposed to open or close ports that can be disposed over different body parts of each sleeper, while keeping the sleeper covered by a lower layer of the system. In some illustrative embodiments, the flaps can be folded off the bed to decrease the amount of insulation on that particular body part for that particular sleeper or left closed in the port to increase the amount of insulation on that particular body part for that particular sleeper.

In some illustrative embodiments, a blanket system in accordance with present disclosure may include two levels or layers. The upper layer or level may be a thicker upper or top layer (similar to a traditional blanket, quilt or comforter) laid over and attached to a lower layer or level which is a relatively thinner fabric (similar to standard bedsheet or lining). The upper layer may include a fixed portion that defines a number of ports and a number of flaps that correspond to the ports. The flaps allow each sleeper to increase or decrease the amount of insulation to different parts of their bodies without the need to displace the entire blanket. A sleeper can remove the thicker top layer away from a particular section of the sleeper's body, by folding the respective flap laterally, from the center towards or off the side of the bed. When a flap is open, the thicker upper layer of that section may hang off the bed rather than on top of the sleeper, and the blanket will provide only the thinner lower level of insulation over the respective body portion, allowing that body part to be relatively cooler. When a flap is closed, that section of the blanket will provide both the upper and lower layers of insulation to that respective portion of the body.

Parallel ports may be disposed on either side of a midline of the system, to allow co-sleepers to individually select and adjust specific respective ports. For example, when a first sleeper is too hot in their midsection, the flap over their midsection section can be folded to the lateral side of the bed, cooling that area while allowing for remaining sections of the blanket system (and the parts covering the other sleeper) to continue providing full warmth. Likewise, if the second sleeper has warm feet, the second sleeper can fold off the flap covering their feet and lower legs without disrupting the remainder of the blanket. Both operations can be done without disturbing the other parts of the blanket covering either sleeper.

It will be appreciated that the various components for a system in accordance with the principles of the present disclosure can be constructed from suitable materials having the requisite strength, durability, softness and insulative values to allow them to function, including woven, felted and piled textiles and other suitable materials. Components may be assembled and attached in any suitable manner, including sewing, heat treatments or the use of suitable adhesives. It will be appreciated that the portions of the assembly discussed herein may be formed as separate members that are joined together, or as one or more integrated units that may be joined together.

Further, it will be appreciated that the various figures and descriptions are merely exemplary and that variations and combinations that fall within the scope of the appended claims are within the teaching of this disclosure. For example, systems in accordance with the present disclosure may have varying numbers of flaps, such as 1, 2, 3, 4 or more flaps which can be folded laterally. Similarly, the position and size of flaps can vary, from closer to the head or foot of the blanket system and from wider to narrower. Additionally, the position of the point where the flaps are permanently attached to the remainder of the system can vary. Although drawings herein may depict the attachment at a seam positioned to reside near an edge of mattress when placed for use, this point could attach the flaps at a side edge or nearer the center line of a system, depending on the intended use.

Further, although systems for use by two sleepers with flaps that open from a center line towards the opposite edges are depicted, a version for a single bed, with only a single set of flaps may be similarly constructed. Likewise, different size systems can be scaled for different size mattresses or bed shapes.

In some embodiments, the system may not include the lower level in the ports, or contains a secondary flap that can be opened, such that when flap is opened, the sleeper's body part is directly exposed, for medical, hospital, nursing home, or disabled person use, providing easy access by a caretaker to a body section without need to disturb the other parts of the blanket.

In some embodiments, the flaps may be attached at their lateral edges to the rest of the blanket by zippers or other fasteners, so the flaps are removable and separately washable.

It will be further appreciated that individuals also have different preferences regarding the amount of weight they like on their body parts as well as insulation. Systems in accordance with the present disclosure allow individuals to regulate weight as well as insulation levels over desired body parts. This may be especially useful where the systems are constructed as weighted blankets as weighted flaps allow a user to selectably control weight over desired body parts.

While various aspects and embodiments have been disclosed herein, other aspects and embodiments are contemplated. The various aspects and embodiments disclosed herein are for purposes of illustration and are not intended to be limiting. Accordingly, other embodiments may be within the scope of the following claims. Unless otherwise noted, the terms "a" or "an," as used in the specification and claims, are to be construed as meaning "at least one of. Additionally, the words "including," "having," and variants thereof (e.g., includes, include, have, and has) as used herein, including the claims, shall be open-ended and have the same meaning as the word "comprising" and variants thereof (e.g., "comprise" and "comprises").

What is claimed is:

1. A multi-layer blanket system comprising:

a body having an upper surface and an opposite lower surface, and wherein the body extends from a top edge to a bottom edge and from a right side edge to a left side edge, and wherein the body comprises a bottom layer comprising a layer of textile material covering a bottom surface of the system;

an upper layer, the upper layer comprising a frame portion that is secured to the bottom layer, wherein the frame portion includes a surrounding portion around the perimeter of the system, comprising a top frame portion, a bottom frame portion, a right side frame portion and a left side frame portion, a vertical member extending from the top frame portion to the bottom frame portion along a center line of the blanket system, and a plurality of horizontal members each extending from a side portion to the vertical member, the frame portion defining a plurality of ports where an upper surface of the bottom layer is exposed, a plurality of flaps comprising a first set of flaps having their first side edges secured to the left side frame portion and a second set of flaps having their first side edges secured to the right side frame portion, with the first set of flaps and the second set or flaps extending to their free ends from opposite sides, each flap of the plurality of flaps corresponding to a port of the plurality of ports such that each flap closes the corresponding port when in a closed position, and when in an open position extends over the surrounding portion past the system to expose the upper surface of the bottom layer in the corresponding port.

2. The system of claim 1, wherein the plurality of flaps comprises at least four flaps.

3. The system of claim 2, wherein the plurality of ports comprises at least four ports.

4. The system of claim 2, wherein the first set of flaps comprises two flaps and the second set of flaps comprises two corresponding flaps.

5. The system of claim 2, wherein the free ends of the first set of flaps and the free ends of the second set of flaps contact one another when both sets of flaps are placed in the closed position.

6. The system of claim 1, wherein the bottom layer is a relatively thinner layer of material, and the upper layer is a relatively thicker layer of material that is more insulative than the bottom layer.

7. The system of claim 6, wherein the upper layer is formed as a duvet having an outer lining surrounding an insulative material.

8. The system of claim 1, further comprising at least one fastener for retaining a flap of the plurality of flaps in the at least one port.

9. The system of claim 8, wherein the at least one fastener comprises a magnet, a button, or a hook and loop material.

10. The system of claim 1, wherein the system is sized such that each flap of the plurality of flaps will hang over the edge of a mattress when in the open position during use, while the corresponding ports remain in place over an upper surface of the mattress.

11. A blanket system comprising:

a body having an upper surface and an opposite lower surface, and wherein the body extends from a top edge to a bottom edge and from a right side edge to a left side edge, and wherein the body comprises a first layer, the first layer comprising a surrounding portion defining a frame around the perimeter of the system, wherein the frame comprises a top frame member, a bottom frame member and two opposite side members, a vertical member extending from the top frame member to the bottom frame member, and a plurality of horizontal members each extending from an opposite side member to the vertical member, the frame defining a plurality of ports, a plurality of flaps, each flap of the plurality having a first side edge that is secured to the surrounding portion along an opposite side edge and extending from a secured side edge to a free end, wherein the plurality of flaps closes the at least one port when in a closed position, and when in an open position extends over the surrounding portion past the system to retain the at least one port in an open position.

12. The system of claim 11, wherein the plurality of flaps comprises a first set of flaps having their first side edges secured to the opposite side edge at a left side and a second set of flaps having their first side edges secured to the opposite side edge at a right side, with the first set of flaps and the second set of flaps extending to their free ends from opposite sides.

13. The system of claim 12, wherein the at least one port comprises a plurality defined by the top frame member, the bottom frame member, the two opposite side members, the vertical member and the plurality of horizontal members, each port corresponding to a flap of the plurality of flaps.

14. The system of claim 12, wherein the first set of flaps comprises two flaps and the second set of flaps comprises two corresponding flaps.

15. The system of claim 12, wherein the free ends of the first set of flaps and the free ends of the second set of flaps contact one another when both sets of flaps are placed in the closed position.

16. The system of claim 11, wherein the first layer is formed as a duvet having an outer lining surrounding an insulative material.

17. The system of claim 11, further comprising at least one fastener for retaining a flap of the plurality of flaps in the at least one port.

18. The system of claim 17, wherein the at least one fastener comprises a magnet, a button, or a hook and loop material.

19. The system of claim 11, further comprising a second layer attached to a lower portion of the first layer and comprising a layer of textile material covering a bottom surface of the system.

20. The system of claim 11, wherein the system is sized such that each flap of the plurality of flaps will hang over the edge of a mattress when in the open position during use.

* * * * *